United States Patent [19]

Woodhouse

[11] 3,938,436

[45] Feb. 17, 1976

[54] SELECTIVE EMBOSSING PRESS WITH DRUM STOP MEANS

[75] Inventor: Eric Douglas Woodhouse, East Kilbride, Scotland

[73] Assignee: Hilti Aktiengesellschaft, Liechtenstein

[22] Filed: Apr. 16, 1974

[21] Appl. No.: 461,423

[30] Foreign Application Priority Data

Apr. 18, 1973 United Kingdom ..... 18610/73

[52] U.S. Cl. ..... 101/18; 101/23; 101/76

[51] Int. Cl.[2] ..... B41J 3/38; B44B 5/00

[58] Field of Search ..... 101/3, 23, 29, 76, 91, 101/92, 93.07, 93.24, 93.10, 224, 226, 227, 110, 18, 19, 20, 29

[56] References Cited

UNITED STATES PATENTS

| | | | |
|---|---|---|---|
| 1,391,890 | 9/1921 | Green | 101/3 R |
| 2,125,443 | 8/1938 | Helsel | 101/227 |
| 2,687,692 | 8/1954 | Kubovy et al. | 101/91 X |
| 2,796,828 | 6/1957 | Ritzerfeld et al. | 101/91 |
| 2,923,131 | 2/1960 | Furman et al. | 101/93.1 X |
| 2,937,592 | 5/1960 | Wockenfuss | 101/91 |
| 3,112,688 | 12/1963 | Ponnier | 101/18 X |
| 3,306,186 | 2/1967 | Voos et al. | 101/18 |
| 3,469,777 | 9/1969 | Anderson | 101/91 X |
| 3,578,766 | 5/1971 | Diolot | 101/23 |
| 3,655,312 | 4/1972 | Erb et al. | 101/23 X |
| 3,701,991 | 10/1972 | Livesay | 101/93.1 X |
| 3,741,114 | 6/1973 | Maul et al. | 101/110 |

*Primary Examiner*—J. Reed Fisher
*Assistant Examiner*—R. E. Suter
*Attorney, Agent, or Firm*—Toren, McGeady and Stanger

[57] ABSTRACT

In an embossing press, a pair of rolls are arranged to be moved toward and away from one another to effect the embossing operation. Each embossing roll includes a number of drums with replaceable indicia plugs on their circumferential peripheries. The drums are detachably coupled to a shaft so that the drums can rotate with the shaft or can be uncoupled while the shaft continues to rotate. A drive system is connected to each of the shafts for rotating them through a predetermined angle of rotation. An arrestor set-up is associated with the drums for uncoupling each drum from its shaft so that a particular indicia plug is located in the operative position of the embossing rolls. A feeder mechanism directs a continuous length of sheet material into the operating position of the rolls and shearing blades, movably connected to the shafts, are arranged to cut the sheet materials into individual sections.

8 Claims, 5 Drawing Figures

SELECTIVE EMBOSSING PRESS WITH DRUM STOP MEANS

SUMMARY OF THE INVENTION

The present invention concerns embossing presses for embossing indicia upon sheet material, such as sheet metal, and, more particularly, it is directed to an embossing arrangement which permits the embossing indicia to be selectively located at the operating position of the rolls. Preferably, operation of the embossing rolls and selection of the indicia to be embossed can be performed from a remote location.

In the present invention the embossing press includes a pair of opposed embossing rolls each including a shaft to which a plurality of indicia drums are coupled so that each drum can rotate with the shaft and can be uncoupled to permit relative rotation between the drum and the shaft. The drums on one of the shafts has upstanding indicia located on their circumferential peripheries while the drums on the other shaft have corresponding complementary indented indicia on their circumferential peripheries. An arrestor device is associated with each of the drums and is selectively engageable with the drums to position a selected indicia in the operating position confronting a corresponding indicia on the corresponding drum of the other shaft. A drive system is connected to each of the shafts for driving the shaft and its associated drums through a predetermined angle of rotation from an initial rest position so that it is possible to move each of the indicia on the drums through the operating position of the embossing rolls. Means are associated with the embossing rolls for urging them toward one another so that sheet material introduced between them can be embossed with the indicia located on the drums in the operating position of the rolls.

The drums may be coupled together for rotation by means of friction, however, it is preferable to provide the coupling action by means of yieldable detents. The yieldable detents interengage each drum with its shaft and comprise a spring-loaded pawl or ball for each of the drums arranged to seat within one of a number of circumferentially spaced detent recesses. The spring-loaded pawl or ball can be located either in the shaft or the drum and, correspondingly, the detent recesses can also be located in either the shaft or drum. When the force holding the yieldable detent within a recess is overcome, it is possible to effect relative rotation between the shaft and the drum.

Conveniently, the detent recesses are formed in the inner periphery of each of the drums while the spring-loaded pawls or balls are located in radial recesses or bores in the circumference of the shaft.

For cooperation with the arresting device of each drum, the outer circumference of the drum may be provided with ratchetlike teeth. Conveniently, however, the outer surface of the drum is provided with radial blind arresting grooves or bores into which the arresting device can seat. Preferably, the arresting device for each drum consists of a plunger extensible into a selected one of the arresting grooves or bores to arrest the drum, with its corresponding indicia in the operating position, during rotation of the shaft by its drive.

The shaft drive means may comprise a hydraulic actuator for each shaft.

These hydraulic actuators are preferably doubleacting so as to be operated to rotate their shafts forwardly from their initial rest positions, and subsequently, after actuation of the pressure means and completion of an embossing operation, to return the shafts to their initial rest positions by reverse rotation.

Preferably, the press includes severing means arranged to be actuated by the means urging the embossing rolls together so that individual sections can be cut from a continuous strip or band of sheet material fed to the press for embossing, whereby indivisual embossed elements or plates can be produced from the continuous strip or band after embossment of each such length.

The severing means may comprise a pair of shearing bars one of which is mounted upon each shaft so that the bars can be displaced from their operative positions when the shafts are rotated forwardly from their initial positions, so that the bars will not obstruct the embossing operation and can be returned to their operating positions when the shafts are returned to their initial rest positions.

Each shearing bar may be mounted on its shaft by bearings which are also constrained to rotate with their shaft by a force which can be overcome to permit relative rotation between the bearings and the shaft, and stop means are provided for defining an inoperative position of each shearing bar.

The press of the invention preferably also includes means for feeding a continuous strip or band of sheet metal to be embossed so as to pass between the embossing rolls.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DETAILED DESCRIPTION OF THE INVENTION

Figure 1:
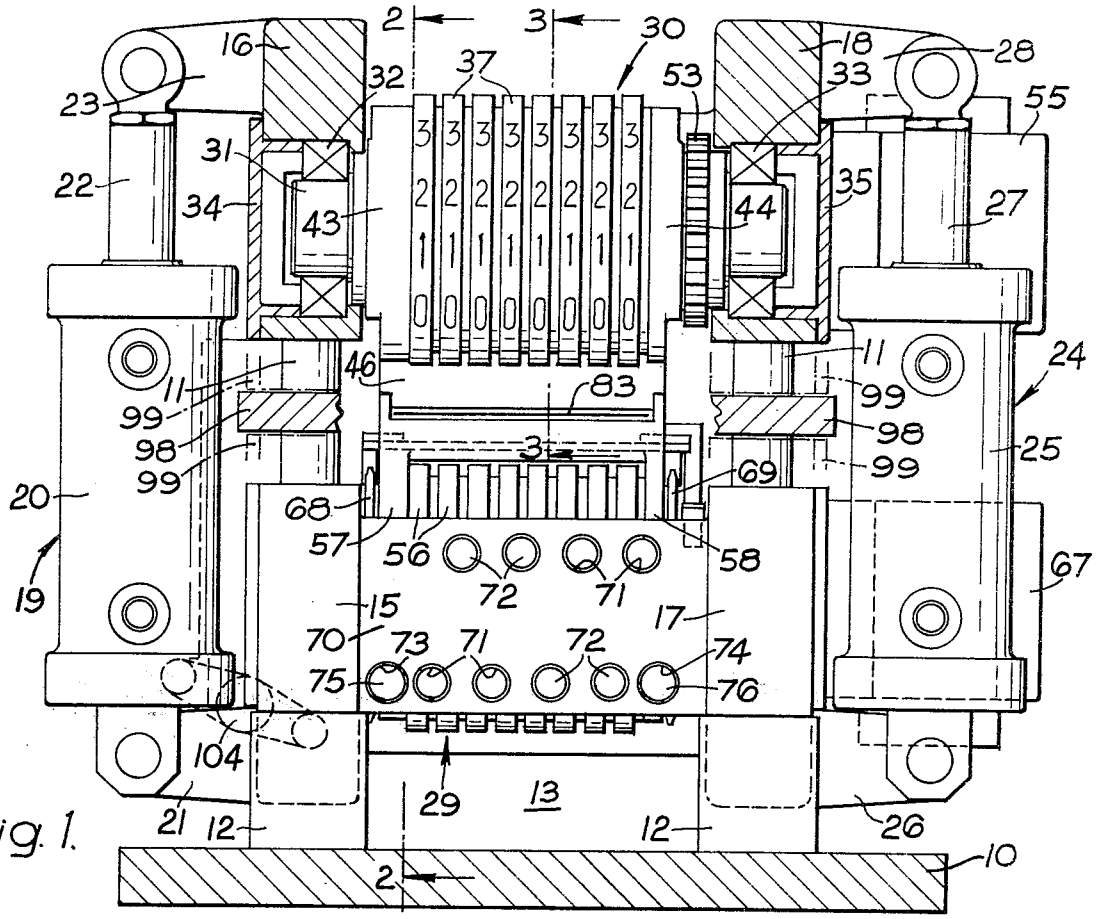
FIG. 1 is a diagrammatic front view, partly in section, of a preferred embodiment of the embossing press incorporating the present invention, the view being taken on the line 1—1 of FIG. 2.

The illustrated embossing press embodying the present invention comprises a substantial base plate 10 from which project four upright guide posts 11, only three of which can be seen in the drawings. Each post 11 has a stop collar 12 secured about it at its bottom end where it connects with the base plate 10. A cross tie 13 connects the collars 12 of the two posts 11 at the front of the press, the left hand side as viewed in FIG. 1, and a cross tie 14 correspondingly connects the collars 12 of the two posts 11 at the rear of the press.

Figure 2:
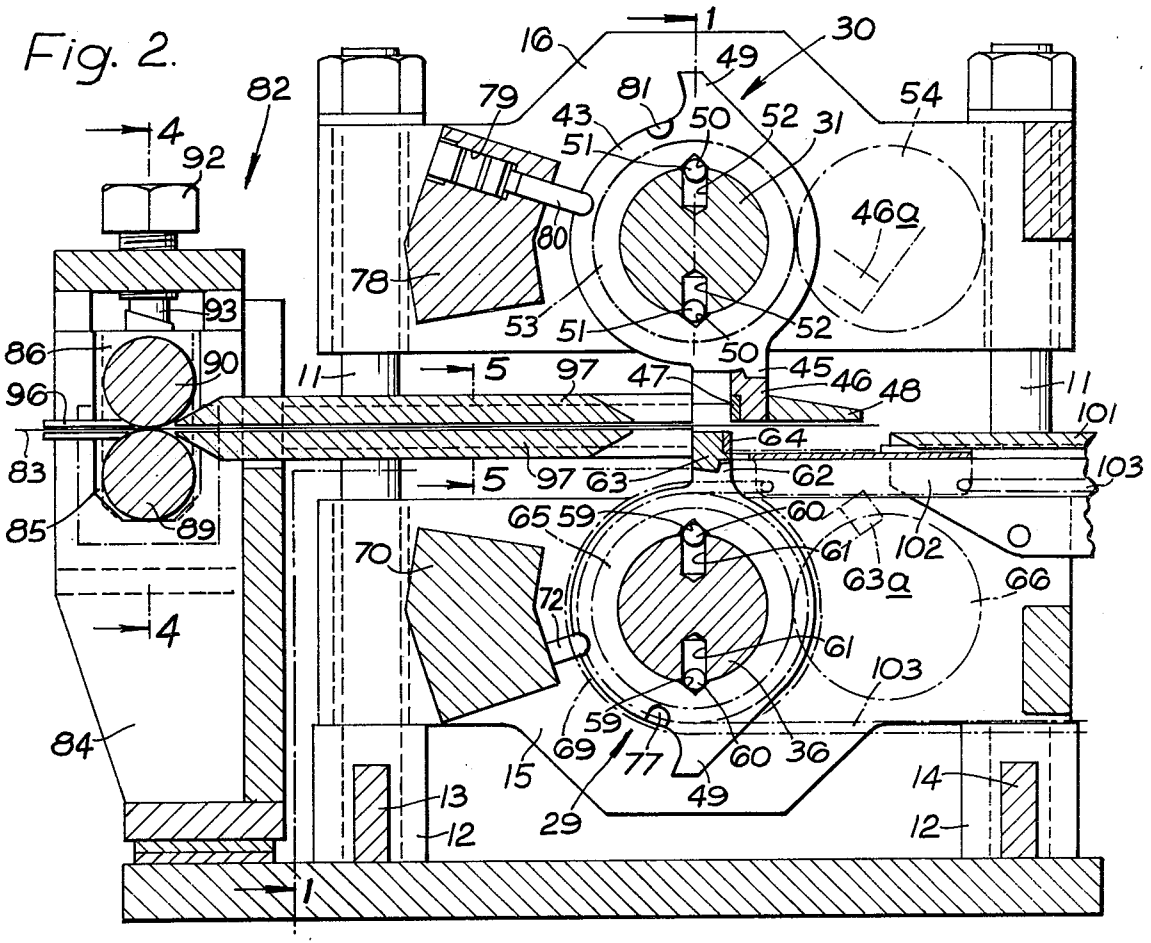
FIG. 2 is a cross-sectional side view of the press taken on the line 2—2 of FIG. 1.

The two posts 11 at the one side of the base plate 10 serve as guides for lower and upper bearing bridges 15, 16, see FIGS. 1 and 2, and the two posts 11 at the other side of the base plate 10 serve as guides for lower and upper bearing bridges 17, 18, the lower bearing bridges 15 and 17 having rest positions resting upon the stop collars 12.

Pressure means for the press includes a first double-acting hydraulic ram 19 whose cylinder 20 is connected to the lower bearing bridge 15 by a bracket 21 and whose piston rod 22 is connected to the upper bearing bridge 16 by a bracket 23, as well as a second double-acting hydraulic ram 24 whose cylinder 25 is connected to the lower bearing bridge 17 by a bracket 26 and whose piston rod 27 is connected to the upper bearing bridge 18 by a bracket 28.

The two lower bearing bridges 15, 17 support between them a lower embossing roll indicated generally by the reference numeral 29, and the two upper bearing bridges 16, 18 support between them an upper embossing roll indicated generally by the reference numeral 30. FIG. 1 shows the manner of mounting the upper embossing roll 30 in the upper bearing bridges 16, 18. Roll 30 includes a shaft 31 with ends located in bearings 32 and 33 held in bearing openings in the bridges 16, 18 by plugs 34 and 35. The lower embossing roll 29 includes shaft 26 (FIG. 2) whose ends are similarly mounted in the lower bearing bridges 15, 17.

Figure 3:
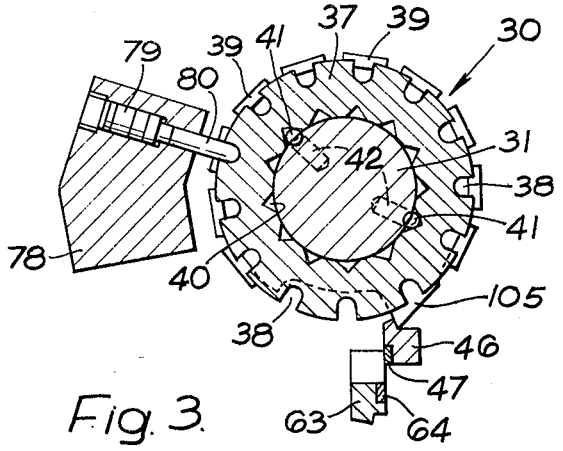
FIG. 3 is a cross-sectional side view of one of the embossing rolls of the press of FIGS. 1 and 2, taken on the line 3—3 of FIG. 1.

As can be seen from FIG. 1, a plurality of indicia drums 37 are mounted on the shaft 31 of the upper roll 30, the drums are illustrated diagrammatically in FIG. 1 and in more detail in FIG. 3. From the latter it will be understood that each drum 37 has a number of radial grooves 38 opening to its outer curved or circumferential surface, these grooves are equispaced and serve to accommodate indicia plugs 39. As illustrated, there are eight indicia drums 37, and each drum has thirteen radial grooves 38. The indicia provided in the present instance are numerals, so there are ten indicia plugs 39 on each drum 37, the other three grooves 38 are unoccupied. As will be appreciated from FIG. 1, the indicia plugs 39 are each secured into their respective grooves 38 at one end of the latter leaving the other ends thereof exposed to act as arresting grooves associated with the indicia plugs 39.

The ten plugs 39 set into each indicia drum bear the numerals 0 to 9, formed on the plugs 39 by indentation.

As can be seen from FIG. 3, each drum 37 is formed, in its inner curved or circumferentially extending surface juxtaposed to the shaft 31, with a succession of thirteen shallow detent recesses 40, each radially aligned with a corresponding one of the grooves 38. Co-operating with the circumferential row of recesses 40 are two detent balls 41 accommodated in the outer ends of radially extending blind bores 42 in the shaft 31 and urged outwardly by loading springs, not shown, accommodated in the bores 42 which are approximately diametrically oppositely disposed in the shaft 31.

The indicia drums 37 on the shaft 31 are accommodated between two bearing rings 43 and 44, of which the bearing ring 44 is a mirror image of the ring 43 whose details are shown in FIG. 2. Each ring 43, 44 has a radial shearing bar lobe 45 to which the ends of an upper transverse shearing bar 46 are connected, the bar 46 has a hardened steel facing 47 set into its front edge and a rearwardly projecting foot 48 secured to its rear side.

Each ring 43, 44 also has a tangential stop lobe 49 formed integrally on it, the lobes 45 and 49 are approximately diametrically disposed.

The inner surface of each bearing ring 43, 44 is formed with two diametrically opposed detent recesses 50 with which detent balls 51 cooperate, the balls are accommodated in the outer ends of radial blind bores 52 which also accommodate respective springs, not shown, which bias the balls 51 outwardly to engage within the recesses 50.

A gear 53 (FIG. 1) is secured to the shaft 31, between the bearing ring 44 and the adjacent upper bearing bridge 18 and is in mesh with a gear 54, see FIG. 2, associated with a hydraulic actuator 55, FIG. 1, mounted on the upper bearing bridge 18. Hydraulic actuator 55 is a double-acting actuator which operates when hydraulic liquid is supplied thereto by one port, not shown, to rotate the shaft 31, and the drums 37 and the bearing rings 43 and 44, in a forward direction (which is counter-clockwise as viewed in FIG. 2) from an initial rest position wherein the parts are arranged as shown in FIG. 2, and when hydraulic liquid is supplied thereto by another port, also not shown, it rotates the shaft 31 in a return direction to its initial rest position.

In a similar manner, a plurality of indicia drums 56 are mounted on the shaft 36 of the lower roll. The drums 56 are similar in shape to the drums 37 and have grooves in which indicia plugs are secured. These plugs differ from the form of the indicia plugs 39, already described, only in that the indicia carried thereby are mirror images of the indicia on the plugs 39 and are upstanding from the outer surfaces of their plugs as compared with the indented indicia on the plugs 39. These drums 56 have detent recesses, similar to the recesses 40, not shown, which are set into the shaft 36 and are similar to the balls 41. Further, the drums 56 are disposed between bearing rings 57 and 58 having detent recesses 59 cooperating with detent balls 60 loaded by springs, not shown, in recesses 61 in the shaft 36, these bearing rings 57 having radial shearing bar lobes 62 to which the ends of a lower transverse shearing bar 63 are connected. This bar 63 has a facing 64 set into its rear face, but does not have a foot corresponding to the foot 48 of the upper shearing bar 46.

A gear 65, omitted from FIG. 1 for the sake of clarity, similar to the gear 53 is secured to the shaft 36 between the bearing ring 58 and the adjacent lower bearing bridge 17 and meshes with a gear 66 associated with a hydraulic actuator 67 mounted on the lower bearing bridge 17.

Also located on the shaft 36, and freely rotatable thereon, is a chainwheel 68 which is disposed between the bearing ring 57 and the adjacent lower bearing bridge 15, as well as a chainwheel 69 which is disposed between the bearing ring 58 and the adjacent gear 65, which, as previously explained, has been omitted from FIG. 1. The purpose of these two chainwheels 68, 69 will be described later.

Arrestor means for the indicia drums 56 of the lower roll 29 comprises a body 70 extending between the lower bearing bridges 15 and 17 in front of the lower embossing roll 29. Formed in the body 70 are two rows of bores 71, not shown in FIG. 2, each of which accommodates a plunger 72, the tip of one of which can be seen in FIG. 2. Since there are eight indicia drums 56 on the shaft 36, there are a corresponding number of bores 71 and plungers 72, and they alternate between the two rows so that for each of the indicia drums 56 there is a plunger 72 aligned with the series of arresting grooves on the outer circumferential periphery of the drum 56.

At each end of one of the rows of plungers 72, a bore 73, 74 is provided for receiving plungers 75, 76 aligned with the bearing rings 57, 58 in which arresting recesses 77, see FIG. 2, are provided.

Corresponding arrestor means, omitted from FIG. 1 for the sake of clarity, are provided for the upper embossing roll 30 and a body 78 with bores 79, plunger 80, and plungers for recesses 81 in the bearing rings 43 and 44.

Hydraulic lines, not shown, are provided between the bores 71, 73, 74 and 79 and an operating mechanism, not shown, which may be computer-controlled and may, for instance include a manual keyboard. The operating mechanism is also connected to the two hydraulic actuators 55 and 67 above described.

Figure 4:
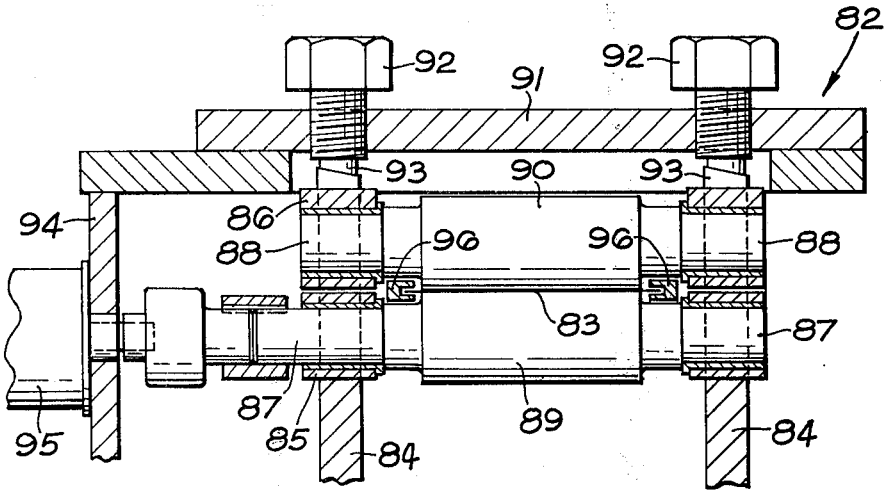
FIG. 4 is a sectional front view of the feed means of the press of FIGS. 1 and 2, on the line 4—4 of FIG. 2.
Figure 5:
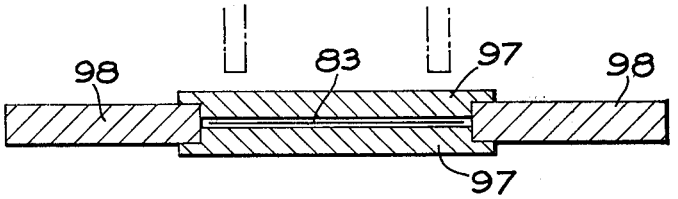
FIG. 5 is a section through a guide forming part of the feed means of the press, taken on the line 5—5 of FIG. 2.

Means for feeding material to the embossing press, indicated generally by the reference numeral 82 in FIG. 2 and illustrated in detail in FIGS. 4 and 5, are provided at the front of the press for feeding a continuous strip or band 83 of sheet material, such as aluminum, to the press for embossment. This feed means comprises a pair of uprights 84 each of which is slotted at its upper end for slidably accommodating lower and upper bearing blocks 85, 86 in which the ends of shafts 87 and 88 of lower and upper feed rollers 89 and 90 are journalled. A crosspiece 91 extends across the tops of the uprights 84 and set therein are feed roller pressure adjusting screws 92 the lower ends of which pass onto telescopically enclosed compression springs 93 which in turn press down on the upper bearing blocks 86. An angle bracket 94 provided on one side of the crosspiece 91 supports a third hydraulic actuator 95, which is a strip feed actuator which rotates in one direction only. Such actuator 95 is coupled to one end of the shaft 87 of the lower feed roller 89.

Supported from the uprights 84 at the entry side of the nip between the two feed rollers 89, 90 are aligned guide channels 96 for guiding the strip or band 83 to the nip. At the exit side of such nip a guide plate assembly is located and it is shown in detail in FIG. 5. The guide plate assembly comprises a pair of spaced apart guide plates 97 defining a passage therebetween for the strip or band 83 to pass therethrough to emerge close to the space between the embossing rolls 29, 30. These guide plates 97 are secured at each side to apertured carrier plates 98 slidably located on the two posts 11 at the front of the press. As has been indicated diagrammatically at 99 in FIG. 1, centering springs are provided on the lower and upper bearing bridges 15, 16, 17, 18 and act on the guide plates 97 to maintain the guide plate assembly at a mid level so that the strip or band 83 emerges substantially midway between the two embossing rolls 29, 30.

The operating mechanism is also connected to the strip feed actuator 95.

Rearwardly of the embossing rolls 29, 30 a guideway 101 is secured to the lower bearing bridges 15, 17 for a take-off carriage 102 the upper surface of which is at a level slightly below the level at which the strip or band 83 emerges from the guide plate assembly. The carriage 102 is connected to chains 103, of which one only is visible, which extend around the chainwheels 68, 69 on the shaft 36 of the lower embossing roll 29 and also around further chainwheels, not shown, disposed to the rear of the press.

The drawings illustrate all of the components of the press in their initial rest positions with the exception of the plungers 72 and 80 which are shown in extended positions and are withdrawn from the embossing rolls 29, 30 in the initial position, as well as the strip or band 83 which is shown in FIG. 2 in an end position wherein the part projecting past the lower shearing bar 63 has been embossed. In its initial rest position, the strip or band 83 will have its leading edge aligned with the rear edge of the facing 64 of the lower shearing bar 63.

Assuming all the parts to be in the initial rest positions, the production of an embossed plate is effected as follows. Firstly the operating mechanism is operated to cause operation of the strip feed actuator 95 to feed the strip or band 83 to between the embossing rolls 29 and 30, for example initially by two steps each equal to a line spacing which is slightly greater than the heights of the indicia on the indicia drums 37, 56. The strip or band 83 is stepped forward by two steps to ensure that embossing does not occur close to the leading edge of the strip or band 83 and it will be understood, of course, that more than two steps forward can be effected, if desired.

Thereupon, the operating mechanism is actuated to set the indicia combination to be embossed by the press. This is done by selecting a desired indicia for each of the upper drums 37 and their corresponding lower drums 56. Thereupon, the operating mechanism is actuated to start the embossing operation. This initiates simultaneous operation of the two hydraulic actuators 55 and 67 which rotate the upper and lower shafts 31 and 36 at identical rotational speeds, the upper shaft 31 rotating counterclockwise and the lower shaft 36 rotating clockwise as viewed in FIG. 2. Because the drums 37, 56 have their recesses 40 engaged by the balls 41, and the bearing rings 43, 44 and 57, 58 have their recesses 50, 59 engaged by the balls 51, 60, the drums 37, 56 initially rotate with the shafts 31, 36, and the shearing bars 46, 63 are swung away from the positions illustrated in FIG. 2.

The operative position of each indicia plug 39 in the upper drums 37 is, of course, when such plug is at its lowermost position as close as possible to the lower embossing roll 29, that is to say when it is just above the rest position, shown in FIG. 2, of the lower shearing bar 63. Correspondingly, the operative position of each indicia plug on the lower drums 56 is when such indicia plug is at its uppermost position, substantially at the rest position of the lower shearing bar 63.

As the selected indicia on each such drum approaches its operative position the corresponding plunger 80 or 72 associated with the drum commences to extend, and engages into the respective groove 38 on the outer periphery of the drum. As a result, each drum 37 and 56 is positively arrested with its selected indicia in the operative position, whilst the shafts 31, 36 continue to rotate to the full extent of the operation of the actuators 55 and 67, which is just less than 360°. The spring-loaded balls 41 yield, of course, to permit this continued rotation of the shafts 31, 36 relative the the drums.

As already mentioned, the shearing bars 46, 63 are swung away from their rest positions during rotation of the shafts 31, 36. These bars 46, 63 are able to swing only to a limited extent to fully withdrawn positions indicated in dotted lines at 46*a*, 63*a* in FIG. 2, as defined by abutment of the stop lobes 49 against the respective bodies 78 and 70 whereupon the plungers 75 are extended to engage in the recesses 81, 77 to lock the shearing bars 46, 63 in such withdrawn positions.

The selected indicia having been brought to the operative positions and the actuators 55 and 67 having reached the ends of their operations, operation of the rams 19, 24 is initiated. This causes the lower bearing bridges 15, 17 to be raised and the upper bearing bridges 16, 18 to be lowered, equalization or such movement being achieved by an equalizing link 104 indicated diagrammatically in FIG. 1. This operation of the rams 19, 24 forces the embossing rolls 29, 30 against the strip or band 83 from opposite sides thereof and embosses the strip or band 83 with the selected indicia.

Thereupon, the rams 19, 24 are actuated to separate the embossing rolls 29, 30; the actuators 55, 67 operate to return the shafts 31, 36 to their rest positions thereby bringing the indicia drums 37, 56 all back to their initial rest positions wherein stop teeth 105, see FIG. 3, on the drums 37, 56 abut their respective shearing bars 46, 63.

The initial rest positions having been achieved, a further embossing operation or further embossing operations can be effected, or the embossed portion of the strip or band 83 can be severed from the rest of such strip or band 83. If further embossing is to be effected, the strip feed actuator 95 is operated to step the strip or band 83 forward as necessary, and indicia selection and embossing is effected in the same way as above described. If severance is required, the feed actuator 95 is operated to forward the strip or band 83 sufficiently to provide the desired length thereof projecting past the lower shearing bar 63, for example, as shown in FIG. 2, whereupon the rams 19, 24 are operated to cause the embossing rolls 29, 30 to move toward each other and the shearing bars 46, 63 to cooperate and shear off the embossed part of the strip or band 83, which part is caused, by the foot 48, to drop down on to the carriage 102.

The rams 19, 24 then separate the rolls 29, 30 and a take-off actuator, not shown, is operated to drive the chains 103 to transport the resultant embossed plate to a delivery location, not shown. The press is then ready for operation again in the manner described.

It will be understood that the operating mechanism for causing the operation of the press in the manner described may be such that each of the steps involved is initiated or effected manually, e.g., by pressing buttons, or that the required steps are stored in a programming arrangement which then becomes effective to cause the various steps to be carried out in the necessary sequence to achieve the desired end result.

The invention is not confined to the precise details of the foregoing example, and variations may be made thereto. For example, instead of the balls 51, 60 detents in the form of spring-loaded pawls, rollers or the like may be employed between the shafts 31, 36 and their drums.

Each of the grooves 38 in the indicia drums 37 and 56 may be replaced by a pair of bores of which one serves for the reception of the respective indicia plug and the other serves as a corresponding arresting bore for engagement therein of the respective plunger.

While specific embodiments of the invention have been shown and described in detail to illustrate the application of the inventive principles, it will be understood that the invention may be embodied otherwise without departing from such principles.

What is claimed is:

1. An embossing press comprising a pair of oppositely disposed embossing rolls, each said embossing roll comprising a shaft, a plurality of indicia drums mounted on said shaft with each said drum mounted opposite a corresponding said drum on the other said shaft, means for releasably coupling said indicia drums to said shaft for rotation of said drums with said shaft, said means permitting the uncoupling of said drums and said shaft on the application of a sufficient force, upstanding indicia mounted on and spaced angularly apart on the outer periphery of said drums of one said shaft, and complementary indented indicia mounted on and spaced angularly apart on the outer periphery of said drums of the other said shaft, shaft drive means operatively connected to each said shaft for rotating each said shaft and said drums thereon from an initial rest position through a predetermined angle of rotation so that all of the indicia on each said drum can be moved into an operative position confronting the corresponding indicia on the corresponding drum on the other said shaft, arrestor means for holding each of said drums in position, each said drum having a plurality of grooves formed therein to provide an interengagement location with said arrestor means for each indicia on said drum, said arrestor means being selectively engageable with said grooves for arresting each said drum with a selected indicia thereon in the operative position and confronting the corresponding said indicia on the corresponding said drum on the other said shaft, pressure means for urging the oppositely disposed embossing rolls toward one another under pressure for embossing with said indicia located in the operative positions, severing means operatively connected to said pressure means to permit individual sections of material to be severed from a continuous length of sheet material fed to the press for embossing so that individual embossed elements or plates can be produced after the embossment of the individual sections, said severing means comprising a pair of shearing bars, one of said shearing bars being mounted on one of said shafts and the other said shearing bar being mounted on the other said shaft so that said shearing bars are displaceable between their operative positions wherein they cooperate with one another, when the shaft are rotated forwardly from their initial positions, so that they will not obstruct the embossing operation and are returned to their operative positions upon return of said shaft to the initial rest position, bearings disconnectedly mounted on each said shaft for rotation therewith so that relative rotation between said bearings and said shaft can be accomplished, each said shearing bar is connected to said bearings for mounting said shearing baroon said shaft with which it is associated, and stop means arranged for defining an inoperative position of each said shearing bar.

2. An embossing press comprising a pair of oppositely disposed embossing rolls, each said embossing roll comprising a shaft, a plurality of indicia drums mounted on said shaft with each said drum mounted opposite a corresponding said drum on the other said shaft, means for releasable coupling said indicia drums to said shaft for rotation of said drums with said shaft, said means permitting the uncoupling of said drums and said shaft on the application of a counter force, upstanding indicia mounted and spaced angularly apart on the outer periphery of said drums of one said shaft, and complementary indented indicia mounted on and spaced angularly apart on the outer periphery of said drums of the other said shaft, shaft drive means operatively connected to each said shaft for rotating each said shaft and said drums thereon from an initial rest position through a predetermined angle of rotation so that all of the indicia on each said drum can be moved into an operative position confronting the corresponding indicia on the corresponding drum on the other said shaft, remotely operated arrestor means for holding each of said drums in position, the outwardly facing surface of each said drum having a plurality of circumferentially spaced radially extending blind arresting grooves being positioned to provide an interengagement location on said drums for each indicia thereon for selectively interengaging with said arrestor means, said arrestor means comprises a body spaced radially outwardly from the outwardly facing surfaces of said indicia drums, a plunger displaceably mounted within said body for each said drum and each said plunger being extensible from said body toward its associated said drum into a selected one of said arresting grooves to hold said drum with its corresponding said indicia in the operative position, so that indicia thereon in the operative position confronts the corresponding said indicia on the corresponding said drum on the other said shaft, and pressure means for urging the oppositely disposed embossing rolls toward one another under pressure for embossing with said indicia located in the operative positions.

3. An embossing press, as set forth in claim 2, wherein said means for coupling said drums to said shaft comprises yieldable detents in one of said drums and said shaft and cooperating recesses in the other of said drums and said shaft.

4. An embossing press, as set forth in claim 3, wherein said yieldable detents each comprise a spring-loaded member cooperating with a circumferentially extending row of said detent recesses, each said recess is associated with a respective one of said indicia so that engagement of said spring-loaded member into any of said detent recesses holds said drum with said indicia associated with said detent recess in the operative position.

5. An embossing press, as set forth in claim 4, wherein said detent recesses are located in the inwardly facing surface of said drum directed toward said shaft and said spring-loaded members are located in radially extending recesses in said shaft.

6. An embossing press, as set forth in claim 2, including severing means operatively connected to said pressure means to permit individual sections of material to be severed from a continuous length of sheet material fed to the press for embossing so that individual embossed elements or plates can be produced by severing individual sections from the continuous lengths after the embossment of the individual sections.

7. An embossing press, as set forth in claim 6, wherein said severing means comprises a pair of shearing bars, one of said shearing bars being mounted on one of said shafts and the other said shearing bar being mounted on the other said shaft so that said shearing bars are displaceable between their operative positions wherein they cooperate with one another, when the shafts are rotated forwardly from their initial positions, so that they will not obstruct the embossing operation and are returned to their operative positions upon return of said shaft to the initial rest position.

8. An embossing press, as set forth in claim 2, wherein feed means are provided for feeding a continuous length of sheet material into position to be embossed between the embossing rolls.

* * * * *